US011230111B2

(12) United States Patent
Koehler et al.

(10) Patent No.: US 11,230,111 B2
(45) Date of Patent: Jan. 25, 2022

(54) PRINTING FLUID SUPPLIES WITH DISPLAYS AND NEARFIELD COMMUNICATIONS

(71) Applicant: HEWLETT-PACKARD DEVELOPMENT COMPANY, L.P., Spring, TX (US)

(72) Inventors: Duane A. Koehler, Vancouver, WA (US); Wesley R. Schalk, Vancouver, WA (US); Howard G. Wong, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/762,316

(22) PCT Filed: Aug. 6, 2018

(86) PCT No.: PCT/US2018/045357
§ 371 (c)(1),
(2) Date: May 7, 2020

(87) PCT Pub. No.: WO2020/032916
PCT Pub. Date: Feb. 13, 2020

(65) Prior Publication Data

US 2021/0170757 A1 Jun. 10, 2021

(51) Int. Cl.
*B41J 2/175* (2006.01)

(52) U.S. Cl.
CPC ..... *B41J 2/17546* (2013.01); *B41J 2/17513* (2013.01); *B41J 2/17523* (2013.01); *B41J 2/17566* (2013.01); *B41J 2002/17589* (2013.01)

(58) Field of Classification Search
CPC .... B41J 2/175; B41J 2/17516; B41J 2/17523; B41J 2/17546; B41J 2/17566; B41J 2002/17589; B41J 2/17513
See application file for complete search history.

(56) References Cited

U.S. PATENT DOCUMENTS 5,699,091 A * 12/1997 Bullock ..... B41J 2/17509 347/19
5,788,388 A 8/1998 Cowger
5,997,121 A 12/1999 Altfather et al.
6,089,687 A * 7/2000 Helterline ..... B41J 2/17546 347/7

(Continued)

FOREIGN PATENT DOCUMENTS

EP 1088668 B1 1/2007
EP 1153752 B1 2/2009

(Continued)

*Primary Examiner* — Anh T Vo
(74) *Attorney, Agent, or Firm* — Fabian VanCott

(57) ABSTRACT

A print supply, the print supply to connect to a printing device to provide a print material to the printing device that includes a fluidic bag within a box to maintain a print material supply, a machine and human readable fluid gauge system that includes a microprocessor to transfer print material level information describing a level of print material within the bag, and a gauge display to represent the level of print material within the bag, and a near field communication device to transfer data describing a level of print material within the print liquid supply.

20 Claims, 5 Drawing Sheets

(56) References Cited

U.S. PATENT DOCUMENTS

| | | | | |
|---|---|---|---|---|
| 6,454,381 | B1 * | 9/2002 | Olsen | B41J 2/17509 347/19 |
| 6,568,775 | B2 | 5/2003 | Zaremba | |
| 6,676,240 | B2 | 1/2004 | Walker | |
| 6,962,078 | B2 | 11/2005 | Angel et al. | |
| 7,845,746 | B2 | 12/2010 | Seino | |
| 8,061,799 | B2 | 11/2011 | Kimura | |
| 2001/0011510 | A1 * | 8/2001 | Koehler | B41F 31/022 101/350.1 |
| 2003/0128245 | A1 | 7/2003 | Walker | |
| 2005/0057586 | A1 | 3/2005 | Brenner | |
| 2006/0077156 | A1 * | 4/2006 | Chui | G02B 26/001 345/85 |
| 2006/0190918 | A1 * | 8/2006 | Edwards | G06F 30/39 716/137 |
| 2007/0040876 | A1 | 2/2007 | Anderson et al. | |
| 2007/0076024 | A1 | 4/2007 | Jeong | |
| 2013/0215467 | A1 | 8/2013 | Fein et al. | |
| 2016/0217108 | A1 * | 7/2016 | Parker | G06F 3/0483 |
| 2018/0250941 | A1 * | 9/2018 | Suzuki | B41J 2/085 |

FOREIGN PATENT DOCUMENTS

| | | | |
|---|---|---|---|
| EP | 1857285 | B1 | 3/2011 |
| GB | 2376663 | B | 11/2004 |
| WO | WO-2017131761 | A1 | 8/2017 |
| WO | WO-2018140025 | A1 | 8/2018 |

* cited by examiner

PRINTING FLUID SUPPLIES WITH DISPLAYS AND NEARFIELD COMMUNICATIONS

BACKGROUND

Some printing devices operate to dispense a liquid onto a surface of a substrate. In some examples, these printing devices may include two-dimensional (2D) and three-dimensional (3D) printing devices. In the context of a 2D printing device, a liquid such as an ink may be deposited onto the surface of the substrate. In the context of a 3D printing device, an additive manufacturing liquid may be dispensed onto a surface of a build platform in order to build up a 3D object during an additive manufacturing process. In these examples, the print liquid is supplied to such printing devices from a reservoir or other supply. The print liquid reservoir holds a volume of print liquid that is passed to a liquid deposition device and ultimately deposited on a surface.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
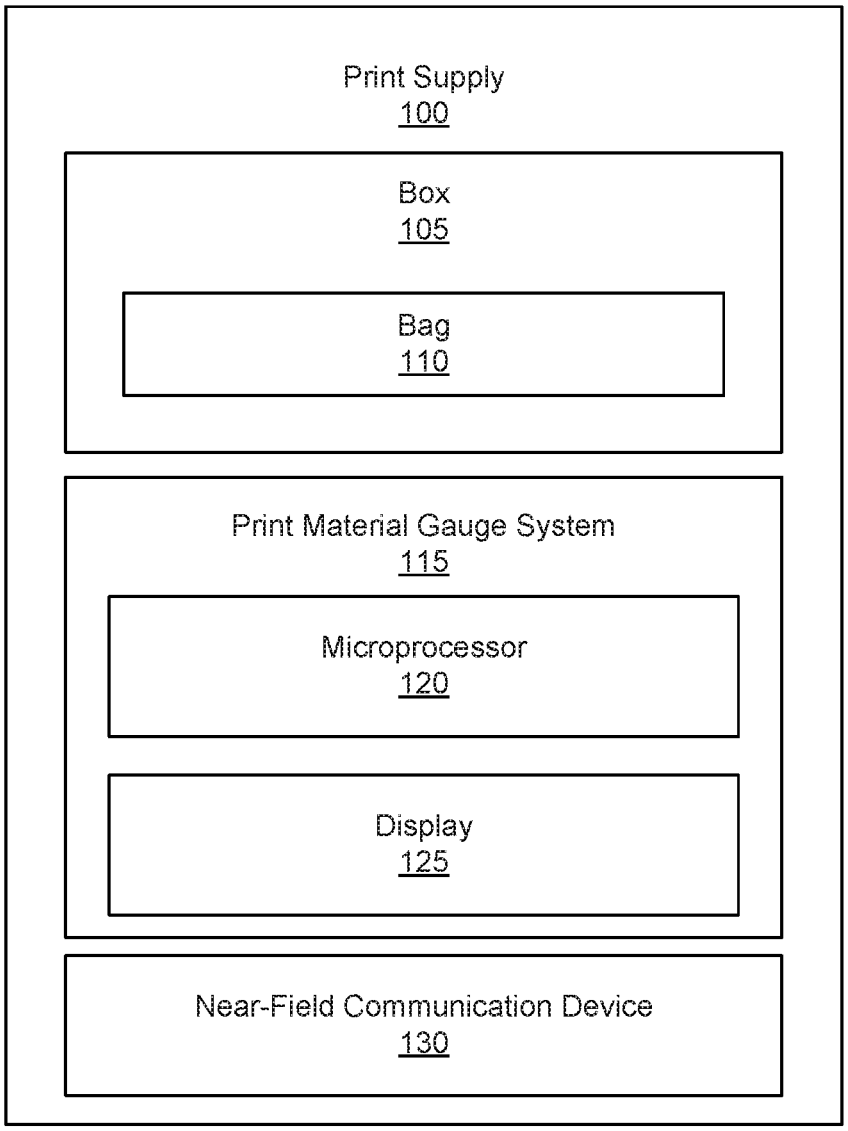
FIG. 1 is a block diagram of a print supply according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In order to handle the large volume of prints provided by multi-user businesses or institutional environments, some printing devices include relatively large, replaceable fluid supplies of printing fluid. These fluid supplies are able to produce tens of thousands of pages before the fluid supply is to be replaced. Consequently, these fluid supplies may maintain relatively large volumes of printing fluid; as much as 5 or more liters per color or type of fluid used by the printing device. Other types of printing devices also may include internal reservoirs that may maintain a relatively large amount of printing fluid. These internal reservoirs may be "topped-off" or resupplied by a fluid supply being fluidically coupled thereto.

These printing devices may also, in some examples, implement continuous fluid supply systems (CFSS), sometimes called continuous ink supply systems (CISS), that may hold volumes greater than or equal to their fluid supply-based equivalents. As many as 3 or more liters of printing fluid may be implemented to completely refill an internal reservoir. However, this refill process can be time-consuming and cumbersome.

The present specification describes a print supply, the print supply to connect to a printing device to provide a print material to the printing device that includes a fluidic bag within a box to maintain a print material supply, a machine and human readable fluid gauge system that includes a microprocessor to transfer print material level information describing a level of print material within the bag, and a gauge display to represent the level of print material within the bag, and a near field communication device to transfer data describing a level of print material within the print liquid supply.

The present specification also describes a replaceable printing fluid supply that includes a container to hold a volume of printing fluid, the container comprising a bag to maintain a fluid therein and a box to hold the bag therein, integrated circuitry to interface with a printing device, and a machine and human readable fluid gauge system communicatively couplable to the printing device via a near-field communication device to receive fluid level data describing the level of fluid within the bag and, via a microprocessor, present a fluid level indicator on a gauge display of the fluid gauge system.

The present specification further describes a fluid supply level indicator that includes a microprocessor to interface, via a near-field communication device, with a printing device and a display to optically represent data describing a fluid level within a fluid supply coupled to the fluid supply level indicator.

As used in the present specification and in the appended claims, the term "fluid" is meant to be understood as any substance that may be received by a printing device in order to form a two-dimensional (2D) image or three-dimensional (3D) object. Examples of fluids may include, without limitations, an ink of any type or color or an additive manufacturing fabrication agent. Still further, as used in the present specification and in the appended claims, the term "fabrication agent" refers to any number of agents that are deposited and includes for example a fusing agent, an inhibitor agent, a binding agent, a coloring agent, and/or a material delivery agent. A material delivery agent refers to a liquid carrier that includes suspended particles of material used in the additive manufacturing process.

Turning now to the figures, FIG. 1 is a block diagram of a print supply (100) according to an example of the principles described herein. In any example presented herein, the print supply (100) may be selectively coupled to a printing device and may supply the printing device with a printing fluid, powder, or any other type of material. In any example, the printing device may include any type of printing device used to receive the printing fluid, powder, or other material and produce a two-dimensional (2D) image on a sheet of media or a three-dimensional (3D) object on a build platform. Consequently, although the present specification may describe the use of the print supply (100) in connection with a 2D image printing device, the present specification contemplates that the processes, methods, and devices may equally apply to a 3D object printing device.

In any example presented herein, the print supply (100) may include a fluidic bag (110) within a box (105). The print supply (100) may include a print material gauge system (115). The print material gauge system (115) may provide a machine and human readable indication of the amount of material within the print supply (100). By way of example, the print material gauge system (115) may indicate to a printing device, via a wireless connection, the amount of print material remaining within the print supply (100). In this example, the print supply (100) may be wirelessly communicatively coupled to the printing device. The wireless communicative coupling of the print supply (100) to the printing device may occur before, after, or concurrently with the print supply (100) forming a fluidic connection with the printing device in order to transfer the print material to the printing device.

The print material gauge system (115) may include a microprocessor (120) and a display (125). In an example, the microprocessor (120) receives a communication from the printing device as to the amount of print material within the print supply (100). The microprocessor (120) may send signals to the display (125) so as to cause a human readable indicator as to the amount of print material within the print supply (100). These signals may be received as specific electrical signals that together create a visual indication that is human readable.

In an example, the microprocessor (120) may communicate with and receive electrical signals from an integrated circuit such as a secure microprocessor interfacing the print supply (100) with the printing device as described herein. In these examples, the integrated circuit may include circuitry that allows a processor to communicate with the print supply (100) and/or gain access to any data storage device of the print supply (100). In examples presented herein, the integrated circuit is a secure microprocessor that, in addition to providing an interface with a processor of a printing device, prevents the unauthorized access of the data storage device of the print supply (100). Although the present specification describes the integrated circuit as a secure microprocessor, the present specification contemplates the use of any circuitry that allows a processor of a printing device to access a data storage device of the print supply (100) securely or otherwise.

The secure microprocessor, being electrically coupled to the printing device, may communicate stored print material level information to the printing device. In this example, the printing device may, in real time, send signals through the electrical interface between the secure microprocessor and the printing device. These signals may be sent to the microprocessor (120) as well via a near-field communication device (130) in order to provide the indication of the level of print material in the print supply (100).

In an example, the display (125) may be an e-ink display. In this example, the e-ink display (125) may receive specific voltage signals from the microprocessor (120) in order to display the print material levels thereon. In this example, the e-ink display is a bi-stable technology. Consequently, the e-ink display may retain its display state even when power is removed from the microprocessor (120) and display (125) when the near-field communication device (130) no longer receives any energy from an initiating antenna on the printing device. This allows a user to visually determine the amount of print material within the print supply (100) without electrically coupling the print supply (100) to a printing device first. With an e-ink display, a user may readily read the levels of print materials within the print supply (100). By being able to determine the print material levels at a glance, a user may prevent the loss or waste of print materials due to premature disposal of the print supply (100). This may be especially true where the print supply (100) is a bag-in-box type print supply (100). Indeed, with a bag-in-box type print supply (100), the amount of print material remaining in the print supply (100) may not be readily discernable when a user, for example, shakes the print supply (100) in order to determine if print material remains therein.

Any type of data may be presented by the display (125). Examples of data may include a type of print material maintained within the print supply (100). A specific "type" of a print material may include descriptions of any characteristic associated with the print material. These characteristics may include a color of the print material, a viscosity of the print material, a size of particles within the print material, a chemical composition of the print material, a manufacturer or supplier of the print material, and/or the manufacturing date of the print material. Consequently, the display (125) may include a visual representation of data describing a color of the print material within the print supply, expiration date of the print material within the print supply, a chemical composition of the print material within the print supply, a level of print material within the print supply, a depletion of the print material within the print supply, information describing a supplier, or combinations thereof.

In an example, the display (125) may also include a machine-readable representation of information associated with the print supply (100) and the print material as described herein. By way of an example, the machine-readable representation may be in the form of any barcode including QR codes. Consequently, the barcode and/or QR code may, when read by a barcode and/or QR code reader, provide a user with the characteristics related to the print material maintained within the print supply (100). These characteristics may include a color of the print material, a viscosity of the print material, a size of particles within the print material, a chemical composition of the print material, a manufacturer or supplier of the print material, and/or the manufacturing date of the print material. Consequently, the display (125) may include a visual representation of data describing a color of the print material within the print supply, expiration date of the print material within the print supply, a chemical composition of the print material within the print supply, a level of print material within the print supply, a depletion of the print material within the print supply, information describing a supplier, or combinations thereof. The use of the barcode and/or QR code may allow a user to quickly scan the barcode and/or QR code with a scanner in order to read this data. In an example, the barcode and/or QR code reader may scan a plurality of print supplies (100) and tally up a total amount of print material among the plurality of print supplies (100) scanned.

In an example, the print supply (100) itself may maintain any amount of print material therein and may be formatted to maintain any amount of print material therein. However, the amount of print material maintained in the print supply (100) may not be readily determined visually especially in situations where the print supply (100) is opaque. In some examples presented herein, the print supply (100) may include a bag (110) within a box (105) with the bag (110) maintaining the print material therein.

These print supplies (100) may be stored for future use in connection with the printing device. Consequently, the amount of print material maintained within the print supply (100) may vary along the lifetime of the print supply (100). Any number of times, the print supply (100) may be physically, electrically, mechanically and/or fluidically coupled to the printing device in order to transfer any amount of print material from the print supply (100) to, for example, an internal reservoir within the printing device. Therefore, it may take a number of iterations of coupling the print supply (100) to the printing device, transferring an amount of print material from the print supply (100) to the reservoir of the printing device, and decoupling the print supply (100) from the printing device for storage. As the print material is depleted from the print supply (100), a processor of the printing device may update the secure microprocessor of the print supply (100) as described herein. The processor of the printing device and/or the secure microprocessor itself may also provide electrical signals to the microprocessor (110) so that the microprocessor (110) can update the information to be displayed on the display (125).

Figure 2:
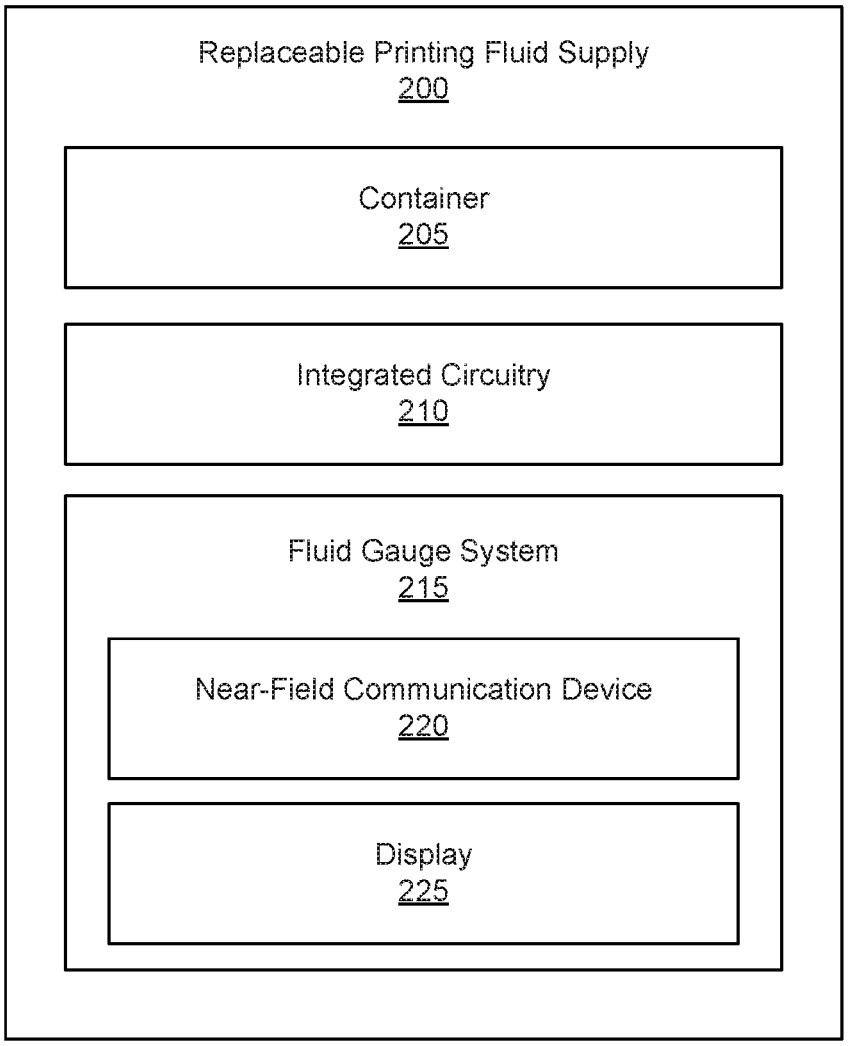
FIG. 2 is a block diagram of a replaceable printing fluid supply according to an example of the principles described herein.

FIG. 2 is a block diagram of a replaceable printing fluid supply (200) according to an example of the principles described herein. The replaceable printing fluid supply (200) may include a container (205) to maintain a volume of printing fluid therein, integrated circuitry such as a secure microprocessor (210) to interface the container (205) to a printing device, and a fluid gauge system (215) to indicate a level of printing fluid within the container (205).

In any example presented herein, the container (205) may include a bag maintained within a box. In some examples presented herein, this type of container (205) may referred to as a bag-in-box fluid supply. The box may provide a structure that is relatively easier to be handled by a user than the bag alone. Accordingly, ease of handling makes the replacement of liquid supplies more ergonomic and leads to a more satisfactory user experience. However, in some examples, the container may include the bag without the box. Additionally, in any example presented herein, the container (205) may be a box without a bag inside.

In any example presented herein, the replaceable printing fluid supply (200) may include a secure microprocessor (210). The secure microprocessor (210) may include any number of electrical leads that, when coupled to an electrical interface of a printing device, electrically couples the fluid gauge system (215) to a processor of the printing device. The number of leads may vary based on the data to be transferred to and from the replaceable printing fluid supply (200) by the printing device. In an example, the secure microprocessor (210) may securely interface with an electrical interface of the printing device that allows for the secure microprocessor (210) to be communicatively coupled with the printing device while a microprocessor associated with the fluid gauge system (215) described herein is also communicatively coupled to the printing device via a near-field communication device (220).

The fluid gauge system (215) may include a display (225). The display (225) may visually convey, to a user, certain properties and characteristics of the replaceable printing fluid supply (200) and/or a printing fluid maintained therein. As described herein, the display (225) may provide visual information such as a color of the printing fluid, a viscosity of the printing fluid, a size of particles within the printing fluid, a chemical composition of the printing fluid, a manufacturer or supplier of the printing fluid, and/or the manufacturing date of the printing fluid. Consequently, the display (225) may include a visual representation of data describing a color of the printing fluid within the print supply, expiration date of the printing fluid within the replaceable printing fluid supply (200), a chemical composition of the printing fluid within the replaceable printing fluid supply (200), a level of printing fluid within the replaceable printing fluid supply (200), a depletion of the printing fluid within the replaceable printing fluid supply (200), information describing a supplier, or combinations thereof.

In any example presented herein, the display (225) may be an e-ink display (225) that is bi-stable so as to retain a visual representation of the information even when power is removed from the display (225). Power may be removed from the display (225) when, for example, the fluid gauge system (215) is removed from a communication/electrical interface, via the near-field communication device (220) of the printing device to which the replaceable printing fluid supply (200) may be coupled.

Figure 3:
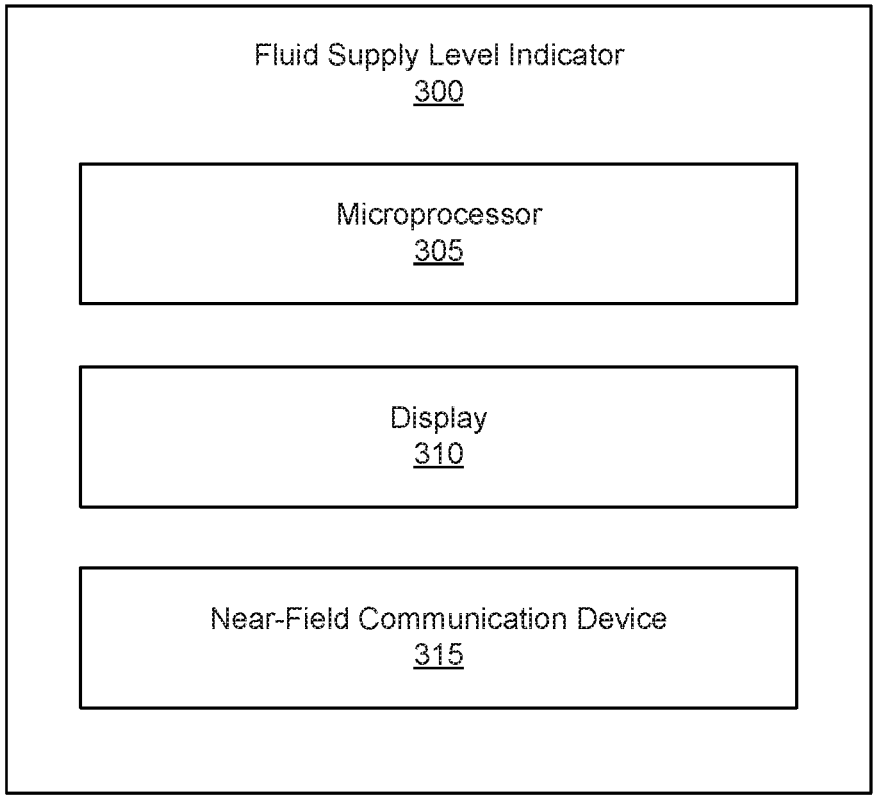
FIG. 3 is a block diagram of a fluid supply level indicator according to an example of the principles described herein.

FIG. 3 is a block diagram of a fluid supply level indicator (300) according to an example of the principles described herein. In an example, the fluid supply level indicator (300) may include a microprocessor (305), a display (310) communicatively coupled to the microprocessor (305), and a near-field communication device (315) to provide for the communication between the printing device and the microprocessor (305).

The fluid supply level indicator (300) may be physically coupled to a fluid supply such as those described in connection with FIGS. 1 and 2. The fluid supply level indicator (300) may be coupled to the fluid supply using any type of coupling devices including adhesives and mechanical devices. In an example, the fluid supply level indicator (300) may be coupled to the fluid supply so that tampering of the fluid supply level indicator (300) or any other attempt to remove the fluid supply level indicator (300) from the fluid supply may be detectable by a user. This may prevent the unauthorized use of the fluid supply level indicator (300) on an unauthorized fluid supply.

The display (310) may be any type of device that may visually present a fluid level within a fluid supply as described herein. The fluid supply level indicator (300) may also receive data and/or signals indicating how to present, on the display (310), the level of fluid within the fluid supply. In any example, the display (310) may be an e-ink display. As described herein, the e-ink display may be bi-stable so as to retain information presented thereon even when power is removed from the display (310).

The fluid supply level indicator (300) may selectively interface with a printing device during use. In this example, the interface may be an electrical and/or mechanical interface. In these examples, any data describing the transfer of the printing fluid to the printing device from the fluid supply may be relayed to the microprocessor (305) via the near-field communication device (315) separate from an interface between the printing device and a secure microprocessor. The microprocessor (305), electrically coupled to a receiver of the near-field communication device (315), may then execute computer program code to interpret the data and relay signals to the display (310) so as to reflect the fluid level within the fluid supply.

Throughout the description, the print supply (FIG. 1, 100) has been described as being used to refill an internal reservoir of a printing device. However, in some examples, the print supply (FIG. 1, 100) may be used to receive print material from the internal reservoir of the printing device so as to empty the internal reservoir or reduce the amount of print material therein. In this example, the printing device may include a pump to pump print material from the internal reservoir of the printing device and into the print supply (FIG. 1, 100). Accordingly, the print material gauge system (FIG. 1, 115) may indicate the level of print material within the print supply (FIG. 1, 100) after receiving the print material from the printing device. Similar to the examples presented herein, the secure microprocessor of the print supply (FIG. 1, 100) may be updated with the information as to the type of print material transferred and other characteristics described herein.

Figure 4:
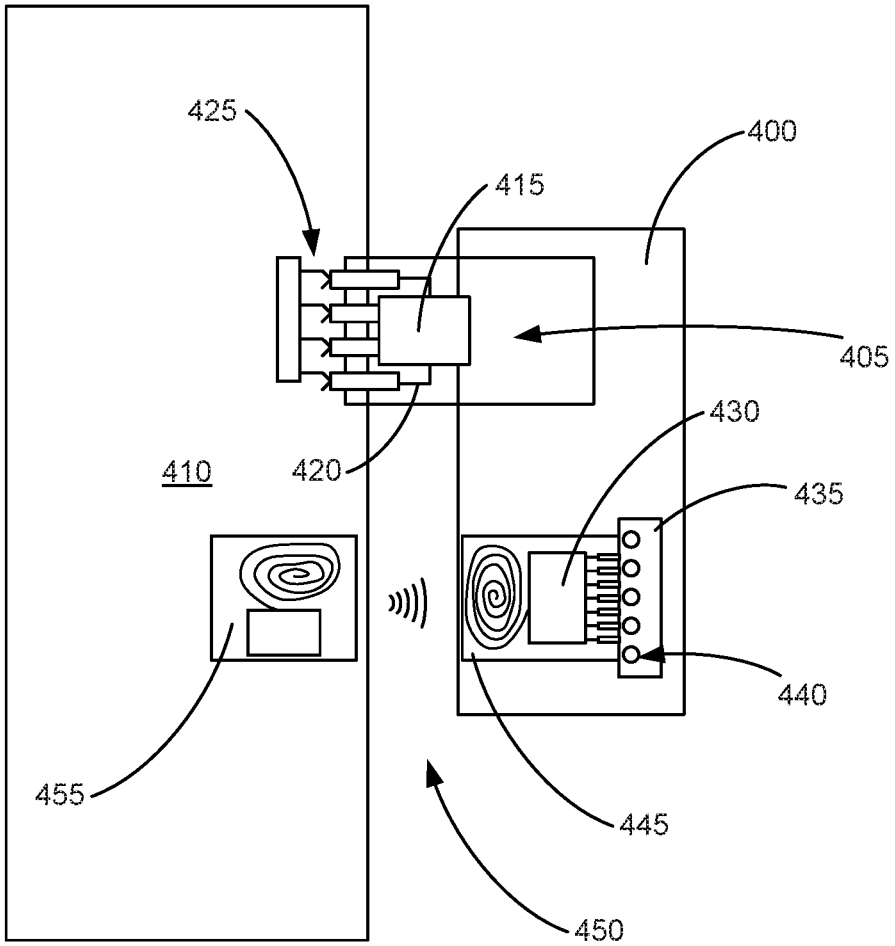
FIG. 4 is a side block view of a fluid supply with a fluid supply level indicator coupled to a printing device according to an example of the principles described herein.

FIG. 4 is a side block view of a fluid supply (400) with a fluid supply level indicator (405) coupled to a printing device (410) according to an example of the principles described herein. The interface between the fluid supply (400) and the printing device (410) may include any of a mechanical interface, a fluidic interface, and/or an electrical interface. The mechanical interface may include any physical devices used to allow the fluid supply (400) to be coupled to the printing device (410). In an example, the mechanical interface may allow the fluid supply (400) to hang from off of the printing device (410) unattended by a user.

The fluidic interface between the fluid supply (400) and the printing device (410) may include any devices that allow for the transfer of a printing fluid from the fluid supply (400) to the printing device (410). These devices may include any valves, fluidic channels, and/or pumps that may be used for the fluid transfer described herein. In an example, the printing device (410) may include a processor and fluid transfer module that, when executed by the processor, monitors for the transfer of fluid and detects, in real time, how much fluid is transferred from the fluid supply (400) to the printing device (410). The printing device (410) may further include a data storage device to maintain a record of how much fluid is transferred from any of a number of fluid supplies (400).

In the example shown in FIG. 4, a first electrical interface between the fluid supply (400) and the printing device (410) is accomplished via the fluid supply level indicator (405) and/or secure microprocessor (415) as well as any electrical leads (420). The electrical leads (420) may couple the secure microprocessor (415) to a number of electrical pads (425) formed on the printing device (410).

In any example presented herein, the fluid supply level indicator (405) may include a microprocessor (430). The microprocessor (430) may be communicatively coupled to the printing device (410) via a receiver (445) of a near-field communication device (450). In an example, fluid level data describing the level of fluid that is present in the fluid supply (400) may be relayed from the printing device (410) to the microprocessor (430) directly. The signals received by the microprocessor (430) may be processed by the microprocessor (430) and sent to a display (435). The display (435) may include any device that may receive the signals from the microprocessor (430) and represent those signals defining the level of fluid within the fluid supply (400). The display (435) may display any indicator (440) that indicates visually to a user the amount of fluid remaining in the fluid supply (400). In the example shown in FIG. 4, the indicators (440) are circles where the number of indicators (440) indicates the level of fluid: the more the number of circles, the higher level of fluid within the fluid supply (400).

Although FIG. 4 shows a specific example of indicators (440) the present specification contemplates the use of other types of indicators and/or information presented on the display (435). As described herein, the display (435) may display a barcode and/or QR code that can be read by a scanning device such as a barcode scanner. In this example, a user, implementing a barcode scanner may scan the barcode and/or QR code so as to determine the level of fluid within the fluid supply (400). This allows a user to maintain a database at, for example, a personal digital assistant (PDA) or other type of computing device. This may allow the user to run an inventory regarding the number of fluid supplies (400) present as well as the amount of fluid in those fluid supplies (400) and an aggregate of specific types of fluid within those number of fluid supplies (400).

The near-field communication device (450) may include a transceiver (455) and the receiver (445). In an example, the transceiver (455) is formed on the printing device (410) while the receiver is formed on the fluid supply (400). In this example, the printing device (410) may, along with the fluid level data, provide an operating power via an electromagnetic field to the receiver (445) in order to operate the microprocessor (430) and display (435). In this example, the near-field communication device (450) may be seen as passive in reference to the fluid supply (400).

Figure 5:
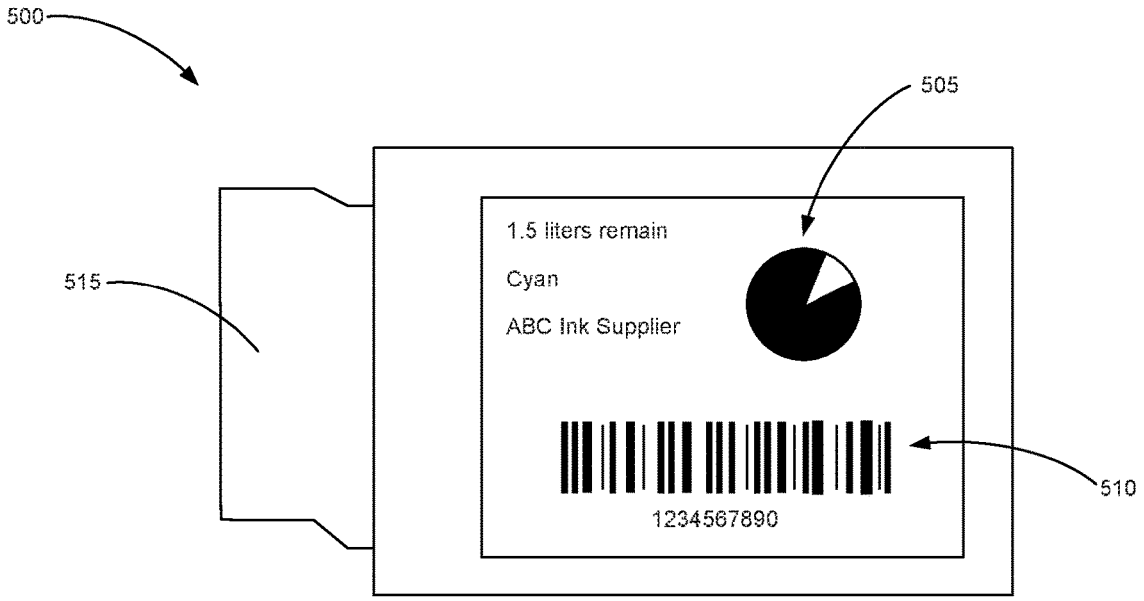
FIG. 5 is a top view of a display according to an example of the principles described herein.

FIG. 5 is a top view of a display (500) according to an example of the principles described herein. As described herein, the display (500) may convey any type of visual information to a user. Among this information as shown in FIG. 5, the amount of fluid remaining ("1.5 liters remain"), the color of the fluid in the fluid supply ("cyan"), and the supplier of the fluid/fluid supply ("ABC Ink Supplier") is shown. A visual printing fluid pie chart (505) may be presented as well showing visually that roughly ⅞ths of the fluid remains in the fluid supply.

As described herein, the display (500) may also include a barcode (510). The barcode (510) may be a scannable barcode that may provide the same or more information to a user than that which is presented on the display (500) in FIG. 5. In an example, other types of scannable images may be used including QR codes.

FIG. 5 shows the display (500) separate from any other devices described herein. However, the form factor of the display (500) shown in FIG. 5 may be relatively larger than that display (FIG. 4, 435) shown in FIG. 4. In this example, the display (500) may have a dedicated ribbon connection (515). The ribbon connection (515) may interface with and connect to the microprocessor and/or secure microprocessor as described herein.

In an example, in addition to providing a visual display of print material levels when the supply is stored, it may also be possible for a user to query the near-field communication device via a separate computing device such as a mobile device. The near-field communication device microprocessor may include some on-board data storage device that may be used to store a copy of what is stored with the secure microprocessor. In an example, the near-field communication device's data storage device may be written to by the printer excluding any other device. However, the data storage device of the near-field communication device may be read anytime by another computing device such as the mobile device. This allows the user to determine the supply level with a relatively greater resolution than what a relatively low-cost display can provide. An aggregation of the fluid among a number of fluid supplies may also be accomplished so the user may determine the total amount of each type of printing material available, collectively, in all of the fluid supplies that are being stored. This would be done, in an example, by a mobile application on the mobile phone that performs the aggregation process. The user may bring the mobile device close to the near-field communication device to each supply being stored.

Although FIG. 5 show a specific contrast (black lettering on white background) of information presented on the display (500), the contrast may be inverted (white lettering on black background). This switching of contrast may be done via a user interface of the printing device as the print supply (FIG. 1, 100) is connected to the printing device. In an example, the contrast may be automatically switched as, for example, the print material in the print supply (FIG. 1, 100) is depleted or when the print material in the print supply (FIG. 1, 100) is completely filled. This may allow a user to immediately determine whether complete depletion or complete filling has occurred in the print supply (FIG. 1, 100).

The systems described herein allows for the transfer of fluid from a fluid supply (FIG. 4, 400) to a printing device (FIG. 4, 410). During operation and use of the fluid supply (FIG. 4, 400), the printing device (FIG. 4, 410) and in particular a processor associated with the printing device (FIG. 4, 410) and executing computer readable program code stored on a data storage device may measure and transfer printing fluid level data to the secure microprocessor (FIG. 4, 415) and/or microprocessor (FIG. 4, 430). In an example, the secure microprocessor (FIG. 4, 415) may include a data storage device as well to store the received printing fluid level data for use in a subsequent printing fluid transfer process. Additionally, the secure microprocessor (FIG. 4, 415) may store executable program code on the data storage device used to, when executed by the processors described herein, achieve the functionality of the fluid supply (FIG. 4, 400) and printing device (FIG. 4, 410) described herein.

The data storage device associated with either the secure microprocessor (FIG. 4, 415) or printing device (FIG. 4, 410) may include various types of memory modules, including volatile and nonvolatile memory. For example, the data storage device of the present example includes Random Access Memory (RAM), Read Only Memory (ROM), and Hard Disk Drive (HDD) memory. Many other types of memory may also be utilized, and the present specification contemplates the use of many varying type(s) of memory in the data storage device as may suit a particular application of the principles described herein. In certain examples, different types of memory in the data storage device may be used for different data storage needs. For example, in certain examples the processor may boot from Read Only Memory (ROM), maintain nonvolatile storage in the Hard Disk Drive (HDD) memory, and execute program code stored in Random Access Memory (RAM).

Generally, the data storage devices may comprise a computer readable medium, a computer readable storage medium, or a non-transitory computer readable medium, among others. For example, the data storage device may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain or store a program for use by or in connection with an instruction execution system, apparatus, or device.

The printing device (FIG. 4, 410) and fluid supply (FIG. 4, 400) may be utilized in any data processing scenario including, stand-alone hardware, mobile applications, through a computing network, or combinations thereof. Further, the printing device (FIG. 4, 410) and fluid supply (FIG. 4, 400) may be used in a computing network, a public cloud network, a private cloud network, a hybrid cloud network, other forms of networks, or combinations thereof. In one example, the methods provided by the printing device (FIG. 4, 410) are provided as a service over a network by, for example, a third party. In this example, the service may comprise, for example, the following: a Software as a Service (SaaS) hosting a number of applications; a Platform as a Service (PaaS) hosting a computing platform comprising, for example, operating systems, hardware, and storage, among others; an Infrastructure as a Service (IaaS) hosting equipment such as, for example, servers, storage components, network, and components, among others; application program interface (API) as a service (APIaaS), other forms of network services, or combinations thereof. The present systems may be implemented on one or multiple hardware platforms, in which the modules in the system can be executed on one or across multiple platforms. Such modules can run on various forms of cloud technologies and hybrid cloud technologies or offered as a SaaS (Software as a service) that can be implemented on or off the cloud. In another example, the methods provided by the printing device (FIG. 4, 410) are executed by a local administrator.

To achieve its desired functionality, the printing device (FIG. 4, 410) may include various hardware components. Among these hardware components may be a number of peripheral device adapters and a number of network adapters. These hardware components may be interconnected through the use of a number of busses and/or network connections. In one example, the processor, data storage device, peripheral device adapters, and network adapter may be communicatively coupled via a bus.

The processor may include the hardware architecture to retrieve executable code from the data storage device and execute the executable code. The executable code may, when executed by the processor, cause the processor to implement at least the functionality of the printing device (FIG. 4, 410) in connection with the fluid supply (FIG. 4, 400), according to the methods of the present specification described herein. In the course of executing code, the processor may receive input from and provide output to a number of the remaining hardware units.

The hardware adapters in the printing device (FIG. 4, 410) enable the processor to interface with various other hardware elements, external and internal to the printing device (FIG. 4, 410) and fluid supply (FIG. 4, 400). For example, the peripheral device adapters may provide an interface to input/output devices, such as, for example, a display device on the printing device (FIG. 4, 410), a mouse, or a keyboard. The peripheral device adapters may also provide access to other external devices such as an external storage device, a number of network devices such as, for example, servers, switches, and routers, client devices, other types of computing devices, and combinations thereof.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general-purpose computer, special purpose computer, or other programmable data processing apparatus to produce a machine, such that the computer usable program code, when executed via, for example, the processor of the printing device (FIG. 4, 410) and/or fluid supply (FIG. 4, 400) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a fluid supply that includes a fluid supply level indicator. In examples, having an active display on a continuous printing fluid supply as described herein may provide a way to visually communicate a printing fluid level to a user without relying on a display associated with a printing device or other computing device. Additionally, the active display described herein does not constrain the choices of materials within the fluid supply, the size of the fluid supply, a form factor of the fluid supply, and/or a filling process implementing the fluid supply. In these examples, the display of the fluid supply can be updated in real-time during a fluid transfer process regardless of the orientation of the fluid supply. Further, in examples where the display is an e-ink display, the printing fluid levels may be retained on the display regardless of whether power is or is not coupled to the display. In these examples, the printing fluid levels indicated may be retained for significant amounts of time before the e-ink images degrade. A user who may be responsible for supplying the printing device with printing fluid may easily view the displays of a plurality of fluid supplies in order to readily ascertain the fluid levels within each of the fluid supplies without physically handling the fluid supplies themselves. The fluid supply and fluid supply level indicators described herein provide for a display that may be controlled through a secure microprocessor interface that may be present in the printing fluid supply. The display can also be scaled to provide other relevant content, such as printer service provider or dealer logos as well as other descriptive characteristics of the fluid provided within the printing fluid supply.

The preceding description has been presented to illustrate and describe examples of the principles described. This description is not intended to be exhaustive or to limit these principles to any precise form disclosed. Many modifications and variations are possible in light of the above teaching.

What is claimed is:

1. A print supply, the print supply to connect to a printing device to provide a print material to the printing device, comprising:

a fluidic bag within a box to maintain a print material supply;

a machine and human readable print material gauge system, comprising:

a microprocessor to transfer print material level information describing a level of print material within the bag; and a display to represent the level of print material within the bag; and a near field communication device to transfer data describing a level of print material within the print supply.

2. The print supply of claim 1, wherein the fluid gauge system is machine readable via the near field communication device on the print supply.

3. The print supply of claim 1, wherein the display is an e-ink display.

4. The print supply of claim 1, wherein the display includes an optically machine-readable representation of data describing:

a color of the print material within the bag;

expiration date of the print material within the bag;

a chemical composition of the print material within the bag;

a level of print material in the bag; or combinations thereof.

5. The print supply of claim 1, wherein the box is opaque.

6. The print supply of claim 1, wherein the display is bi-stable so as to retain a state of display when power is removed.

7. The print supply of claim 1, wherein the machine and human readable print material gauge system is to present a barcode or QR code as a machine-readable element on the display and an additional graph or numeric value as a human-readable element on the display, both the machine-readable and human-readable elements indicating the level of print material in the bag.

8. The print supply of claim 1, wherein the display is attached to the box.

9. The print supply of claim 1, wherein the microprocessor is to receive data describing the level of print material within the print supply via the near field communication device from the printing device and control the display to represent the level of print material within the bag.

10. The print supply of claim 1, wherein the print material gauge system is attached to the box such that an attempt to remove the gauge system from the box will be evident to a user.

11. The print supply of claim 1, further comprising an interface to receive print material from the printing device into the bag, the print material gauge system to indicate the level of print material within the print supply after receiving print material from the printing device.

12. A replaceable printing fluid supply, comprising:

a container to hold a volume of printing fluid;

integrated circuitry to interface with a printing device; and a machine and human readable fluid gauge system communicatively couplable to the printing device via a near-field communication device to receive fluid level data describing the level of fluid within the container and, via a microprocessor, present a fluid level indicator on a display of the fluid gauge system.

13. The replaceable printing fluid supply of claim 12, wherein the near-field communication device is a passive near-field communication device.

14. The replaceable printing fluid supply of claim 12, wherein the display is an e-ink display.

15. The replaceable printing fluid supply of claim 12, wherein the display includes an optically machine-readable representation of data describing:

a color of the fluid within the bag;

expiration date of the fluid within the bag;

a chemical composition of the fluid within the bag;

a level of fluid in the bag; or combinations thereof.

16. The replaceable printing fluid supply of claim 12, wherein the integrated circuitry provides authentication of the fluid level data prior to display by the microprocess on the fluid gauge system.

17. A fluid supply level indicator, comprising:

a microprocessor to interface, via a near-field communication device, with a printing device; and a display to optically represent data describing a fluid level within a fluid supply coupled to the fluid supply level indicator, the microprocessor to control the display based on data received by the microprocessor from the printing device via the near-field communication device that describes usage by the printing device of fluid from the fluid supply.

18. The fluid supply level indicator of claim 17, wherein the display is a bi-stable e-ink display.

19. The fluid supply level indicator of claim 17, communicatively coupled to an integrated circuit to provide authentication of the data describing the fluid level of the fluid supply.

20. The fluid supply level indicator of claim 19, comprising a number of electrical leads to interface the integrated circuit to the printing device.

* * * * *